US007347129B1

(12) United States Patent
Youtsey

(10) Patent No.: US 7,347,129 B1
(45) Date of Patent: Mar. 25, 2008

(54) TOOL OPERABLE FOR CONNECTING A MALE F-TYPE COAXIAL CABLE CONNECTOR

(75) Inventor: Timothy L. Youtsey, Scottsdale, AZ (US)

(73) Assignee: Phoenix Communications Technologies International, Gilbert, AZ (US)

( * ) Notice: Subject to any disclaimer, the term of this patent is extended or adjusted under 35 U.S.C. 154(b) by 0 days.

(21) Appl. No.: 11/580,280

(22) Filed: Oct. 13, 2006

(51) Int. Cl.
*B25B 23/155* (2006.01)
*B25B 13/00* (2006.01)

(52) U.S. Cl. ..... 81/467; 81/124.2; 81/472

(58) Field of Classification Search ..... 81/124.2, 81/64, 467, 472, 475, 478
See application file for complete search history.

(56) References Cited

U.S. PATENT DOCUMENTS 508,314 A * 11/1893 Hill ..... 279/23.1
1,092,574 A * 4/1914 Jannson ..... 81/477
4,215,600 A * 8/1980 Kesselman ..... 81/471
5,415,065 A * 5/1995 McMills ..... 81/467
5,507,211 A * 4/1996 Wagner ..... 81/472
5,615,587 A * 4/1997 Foerster, Jr. ..... 81/64
6,817,272 B2 * 11/2004 Holland ..... 81/124.2
6,848,920 B2 * 2/2005 Fox ..... 439/133
7,080,581 B2 * 7/2006 Reese ..... 81/124.2
7,249,540 B1 * 7/2007 Hacker et al. ..... 81/124.5

* cited by examiner

*Primary Examiner*—Hadi Shakeri
(74) *Attorney, Agent, or Firm*—Troxell Law Office, PLLC

(57) ABSTRACT

A tool including a tubular wrench portion and a hollow grasping portion. The tubular wrench portion has a first end, a second end, a hollow body portion located between the first and second ends and a plurality of arc portions located at the first end. The hollow body portion has a first slot extending from the first end to the second end. The arc portions have an outer surface for installing the C-shaped fastening ring thereon to generate torsion and an inner surface formed with a shaped portion to engage with a shaped outer surface of a connector ring. The arc portions are outwardly extended by the torsion when a predetermined torsion is enough to deform the arc portions of the tubular wrench portion.

4 Claims, 4 Drawing Sheets

TOOL OPERABLE FOR CONNECTING A MALE F-TYPE COAXIAL CABLE CONNECTOR

BACKGROUND OF THE INVENTION

1. Field of the Invention

The invention relates to a tool for attaching a male F-type coaxial cable connector to a female F-type coaxial cable connector.

2. Prior Art

Screw-on F-type connectors are used on most RF coaxial cables to interconnect TV's, Cable TV decoders, VCR/DVD's, hard disk digital recorders, satellite receivers, video games, TV signal distribution splitters and switches. Initially, F cables (an RG-6 or RG-59 type coaxial cable with a male F-type connector at each end) were used in simple installations to interconnect a TV to a cable box, VCR or video game, with ample room between the devices to interconnect the cables by hand. The space behind such devices permitted a large bend radius for the cable between or behind the devices. An RG-6 cable, with an O.D. of 27 inches requires a minimum bend radius of 3 inches as specified by manufactures.

Due to space limitations imposed by the increased number of TV devices that are now interconnected in one small, high-density space or console, it has become difficult to install and remove the interconnecting F cables without first removing the device from the congested area or console. Many of these devices, such as large screen TV sets, are now positioned as close to a wall as possible forcing the F cables to make sharp bends in order to interconnect the cable to an adjacent device. As artisans skilled in the art of cable installation will appreciate, it is both the sharp bends formed in the semirigid coaxial F cables and the high density of these cables in current installations that have made the present means for installing, un-installing, tightening and loosening F-type connectors difficult and time consuming. It is the intention of this invention to provide a novel solution to this new density problem.

F connectors have a standardized design, using a 7/16 inch hex nut as the rotational connecting ring. The nut has a relatively short 1/8 to 1/4 inch length available for finger contact. The internal threads on the nut and matching F female are a 3/8-32 thread, requiring the male connector to be positioned exactly in-line with the female connector for successful thread engagement as rotation begins. When the cable extends rearwardly from the connector and is both in-line with the threaded outer surface of the female connector and straight for some distance, aligning the male connector in the proper plane is not difficult. However, when the cable is bent adjacent to the male F-type connector, as is the case where the rear-mounted F connector on the device is adjacent a wall or cabinet surface, the installer must first straighten the cable for some distance so that the F male on that cable can easily screw onto the female.

The F male connector in accordance with the prior art is designed to be screwed onto and off of the F female connector using the fingers. The hex shaped nut is provided for wrench tightening the connector after the male F connector is fully screwed onto the female F connector by the fingers (usually 4 turns). To maintain a tight electrical connection and to meet the intended electrical performance, manufacturers and industry standards require the F connector to be tightened beyond the torque achievable by using only the fingers. In the case of cable TV products, the standard has been to tighten the connector to a 25 in-lb torque or another 90-120 degrees from the finger tight position. Consumer products which have weaker female mounting structures (usually plastic) require their F connectors to be wrench-tightened just slightly beyond finger tight. When the cable is bent, the torque required to install or remove a male F connector increases. Thus, a tool operable for providing the additional torque is required for the installation or removal of the male F connector when the attached cable is in a bent position.

There are currently two tools and methods for using the tools for tightening and loosening F connectors. A first tool is a standard open-end 7/16 inch crescent wrench with a minimum shaft length of 4-6 inches. The use of this tool requires an unobstructed area for radial rotation of the tool around the axis of the F-type connectors once the threads on both male and female have been engaged. Sufficient radial open space is rarely available on TV devices where many other connectors and cables project from a device and occupy a small area.

The second tool, originally designed to install F cables through security devices in a cable system, are currently used to install F cables in dense locations. This tool consists of a 7/16 inch hex nut driver socket with a slot on the side to allow the socket to slide over an installed cable. The disadvantage of this tool is that the cable must be in a straight line with the male and female connectors being mated. This condition is no longer the typical installation situation; making this tool ineffective for its intended use. There is a need for a tool that can be used to connect and disconnect male F connectors in high cable density applications.

Zamanzadeh, in U.S. Pat. No. 5,992,010, discloses a coaxial cable connector tool that includes a hollow elongated housing comprised of two halves hinged together. The halves are closed around a female coaxial cable connector. When the halves are closed, a hexagonal hole is formed at one end, and another hole is formed at the opposite end. The hexagonal sleeve on the connector is snugly positioned in the hexagonal hole, and the cable is positioned through the opposite hole. The sleeve is then rotated by turning the housing by hand. The housing is substantially wider than the sleeve on the connector, and includes a hexagonal outer surface, so that it may be easily gripped and turned by hand. In a second embodiment, the housing is provided as a built-in component on new connectors.

As mentioned earlier, when an F cable is bent, the torque required to loosen the connector nut increases five fold, making it almost impossible to unscrew with the fingers without the benefit of a mechanical advantage. Notwithstanding the recognition of the problem in the prior art and the tools devised to solve the problem, a commonly practiced method for cable installation is to remove the TV or similar device from the console cabinet or move it away from a wall, thereby allowing the cable to straighten; making the connection with the fingers, with or without a tool, and then returning the device into the confined space.

Modern TV-related product interconnections are now made in tight spaces such as home master distribution boxes, inside home entertainment consoles, behind TV/VCR stands, etc., where most, if not all, of the coaxial cables are bent immediately from the plane of attachment to the device in order to most efficiently reach the device connected thereto. Accordingly, there is a current need for a tool for connecting or disconnecting a male F-type connector that is operable in confined spaces and provides the desired torque under conditions wherein the cable is bent adjacent to the connector.

SUMMARY

It is an object of the invention to provide a tool for attaching an F-type male connector having a coaxial cable attached thereto to a female F-type connector affixed to a device wherein the space between the female F-type connector and nearby structures requires that the coaxial cable be bent.

It is another object of the invention to provide a tool for meeting the above objective and operable for applying a more secure attachment of the male connector to the female connector than can be achieved using only the fingers.

It is a further object of the invention to provide a tool for attaching an F-type male connector to prevent a shaped outer surface of a connector ring from being worn by the tool.

The invention provides a tool operable for connecting a male F-type coaxial cable connector having a male F-type coaxial cable connector and a coaxial cable, operable for connecting the male F-type coaxial cable connector to a female F-type connector, wherein the male F-type coaxial cable connector comprises a leading end, a trailing end and a connector ring rotatably disposed at the leading end and the coaxial cable extends rearwardly from the trailing end, wherein the connector ring comprises a threaded inner surface and a shaped outer surface, or operable for disconnecting the male F-type coaxial cable connector from the female F-type connector.

The tool comprises a tubular wrench portion and a hollow grasping portion. The tubular wrench portion comprises a first end, a second end, a hollow body portion located between the first and second ends and a plurality of arc portions located at the first end. The hollow body portion has a first slot extends from the first end to the second end, wherein the arc portions have an outer surface for installing the C-shaped fastening ring thereon to generate torsion and an inner surface formed with a shaped portion to engage with the shaped outer surface of the connector ring. The arc portions are outwardly extended by the torsion when the predetermined torsion is enough to deform the arc portions of the tubular wrench portion. The hollow grasping portion comprises an annular front end disposing on the second end of the tubular wrench portion, a distal end, and a second slot formed between the annular front end and the distal end and connected to the first slot of the hollow body portion. The tool is particularly operable for performing the connection or disconnection of the F-type cable structure when the nearby bent coaxial cables exist. The tool is particularly useful for connecting the male connector to the female F-type connector when the coaxial cable is bent, or disconnecting the male F-type coaxial cable connector from the female F-type connector.

The features of the invention believed to be novel are set forth with particularity in the appended claims. However the invention itself, both as to organization and method of operation, together with further objects and advantages thereof may be best understood by reference to the following description taken in conjunction with the accompanying drawings.

DESCRIPTION OF THE PREFERRED EMBODIMENTS

Figure 1:
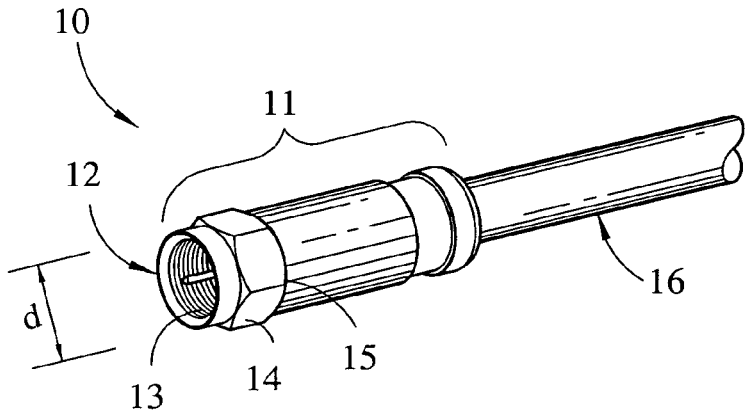
FIG.1 PRIOR ART
FIG. 1 is a perspective view of an F-type cable structure having a male F-type coaxial cable connector and a coaxial cable connected to the male F-type coaxial cable connector.

FIG. 1 is a perspective view of an F-type cable structure 10 having a cable 16 and a male F-type coaxial cable connector 11 attached thereto. The male F-type coaxial cable connector 11 has a connector ring 12 rotatably mounted thereon. The inner surface 13 of the connector ring 12 is threaded and the outer surface 14 is shaped to permit rotatably locking engagement between the connector ring 12 and a tool (not shown) such as a hexagonal, open-end wrench. The trailing end 15 of the connector ring 12 includes a stepped shoulder. In FIG. 1, the cable 16 is shown as straight, extending reardwardly from the connector 11. In practical installations, the cable 16 is bent adjacent the connector 11, rendering operation of prior art tightening wrenches difficult.

Figure 2:
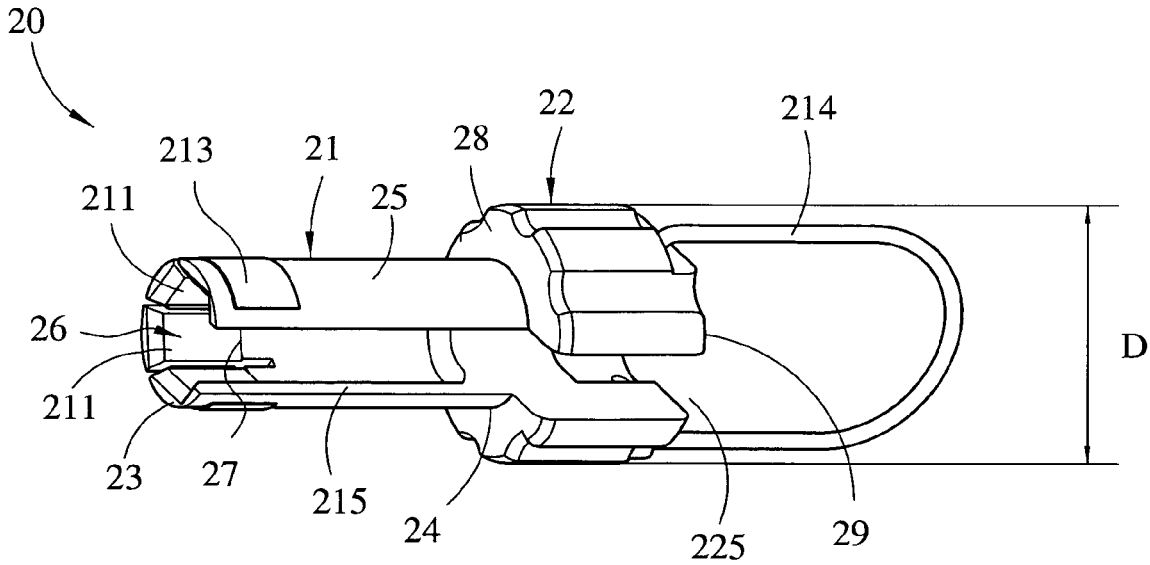
FIG. 2 is a perspective view of a coaxial cable connector tool of the present invention.
Figure 3:
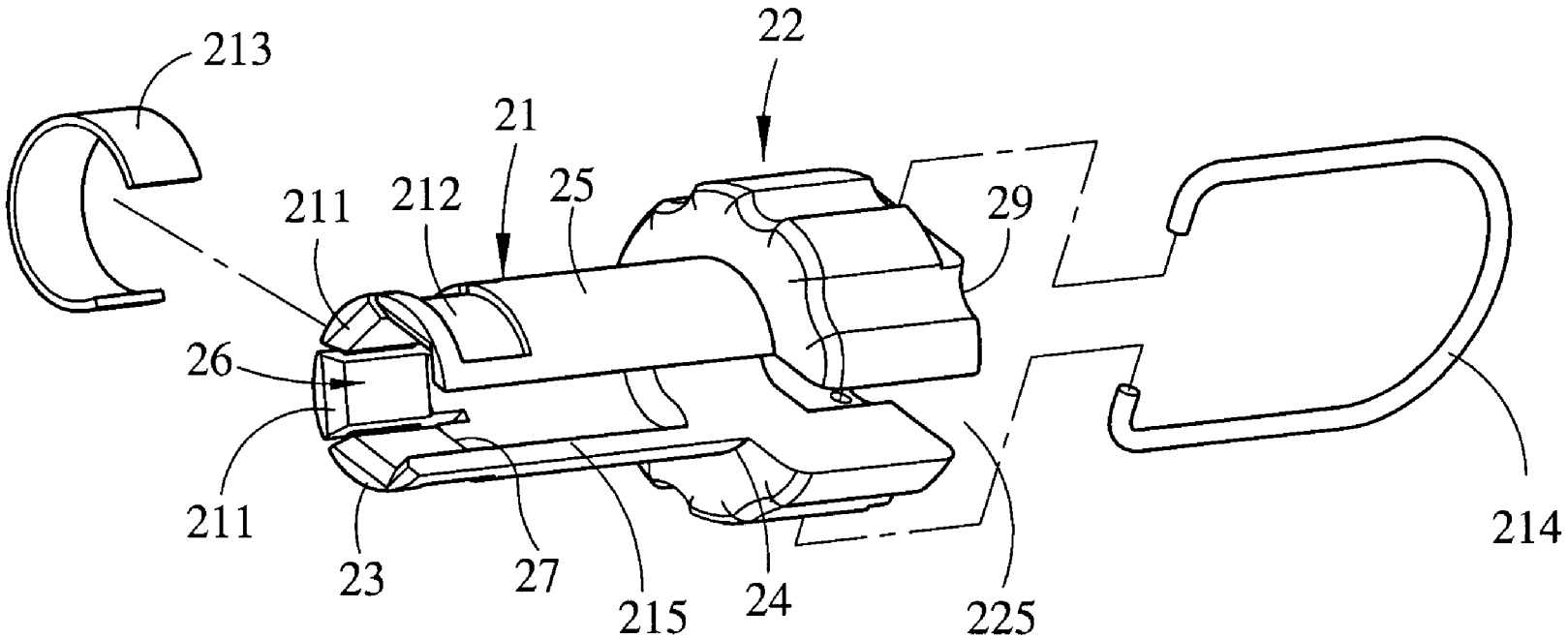
FIG. 3 is a perspective view of a device having a plurality of female F-type connectors affixed thereto illustrating the preferred embodiment of the tool shown in FIG. 2 being employed to attach (or detach) a male F-type connector to a female F-type connector mounted on the device.

In FIGS. 2 and 3, a coaxial cable installing tool 20 of the invention comprises a tubular wrench portion 21, a hollow grasping portion 22 and a C-shaped fastening ring 213. The tubular wrench portion 21 comprises a first end 23, a second end 24, a hollow body portion 25 located between the first and second ends 23 and 24, four equi-spaced arc portions 211 located at the first end 23, an inner surface and a stepped thrusting portion 27 formed on the inner surface to prevent the tubular wrench portion 21 from going beyond the connector ring 12. The hollow body portion 25 having a first slot 215 in the wall thereof coextensive with the axial length of the tubular wrench portion 21. The arc portions 211 are provided with an outer surface formed with a C-shaped recess 212 for installing the C-shaped fastening ring 213 thereon to generate torsion and an inner surface formed with a shaped portion 26 to engage with the shaped outer surface 14 of the connector ring 12 of the male F-type coaxial cable connector 11. In this embodiment, the C-shaped fastening ring 213 is made of a rigid material.

When the generated torsion is enough to deform the arc portions 211 of the tubular wrench portion 21, the arc portions 211 are outwardly extended by the torsion. Furthermore, the C-shaped fastening ring 213 disposed on the C-shaped recess 212 of the outer surface of the arc portions 211 prevents the shaped outer surface 14 of the connector ring 12 from being worn by the tool 20.

The hollow grasping portion 22 comprises an annular front end 28 disposing on the second end 24 of the tubular wrench portion 21, a distal end 29, a second slot 225 formed between the annular front end 28 and the distal end 29, and a ring 214 detachably connected to the distal end 29. The second slot 225 formed between the annular front end 28 and the distal end 29 is connected to the first slot 215 of the hollow body portion 25. With the ring 214, the user can hang the tool 20 on his or her belt.

Figure 4:
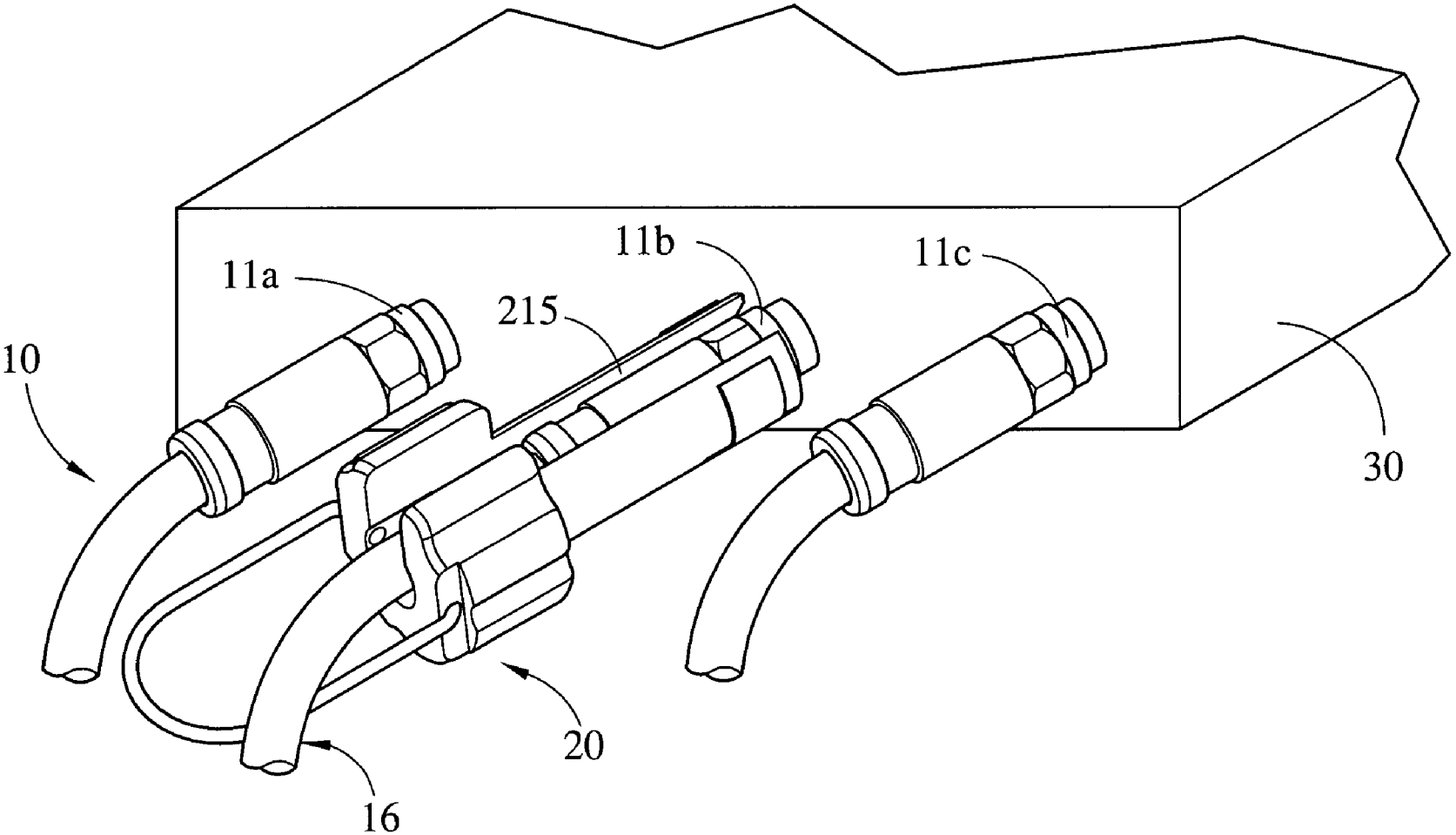
FIG. 4 is a perspective view of the tool disposed on one of the F-type cable structures connected to a device to perform the connection or disconnection step.

The operation of the tool 20 can best be understood by reference to FIG. 4. FIG. 4 is a perspective view of a device 30 having a plurality of female F-type connectors thereon with a plurality of male connectors 11*a*, 11*b* and 11*c* affixed thereto, illustrating the preferred embodiment of the tool 20 shown in FIG. 2 being employed to attach (or detach) a male F-type coaxial cable connector 11 to a female F-type connector mounted on the device. By turning the F-type cable structure 10 with the tool 20 along the disconnection direction, the F-type cable structure 10 can be easily disconnected from the device 30. On the other hand, the F-type cable structure 10 can be connected to the device 30 by the tool 20 turning along the installation direction. The portion of the coaxial cable 16 adjacent to the male connectors 11*a*-11*c* are bent as is the case in most situations. For example, the bent coaxial cable 16 exerts a lateral force on the male F-type coaxial cable connector 11 that substantially increases the torque required to turn the connector ring 12.

When the tool 20 is mounted on the F-type cable structure 10, the coaxial cable 16 is inserted through the first slot 215 and the second slot 225 of the tool 20. The tool 20 is advanced along the length of the coaxial cable 16 when the stepped thrusting portion 27 thereof formed on the inner surface of the tubular wrench portion 21 engages the stepped shoulder located at the trailing end 15 of the connector ring 12.

That is to say, when the tool 20 is disposed with respect to the F-type cable structure 10*b*, the shaped portion 26 of the inner surface of the arc portions 211 of the tool 20 is engaged to the shaped outer surface 14 of the connector ring 12. The annular front end 28 of the hollow grasping portion 22 is gripped by the fingers and the tool 20 is twisted in clockwise to engage the F-type cable structure 10, or in counterclockwise to disconnect from the F-type cable structure 10. The outer diameter D of the grasping portion 22 of the tool 20 is far greater than the outer diameter d of the connector ring 12 of the F-type cable structure 10. Thus, a mechanical advantage generated therefrom provides an adequate torsion to effectively connect the connector ring 12 of the F-type cable structure 10 to a designated connector.

Figure 5:
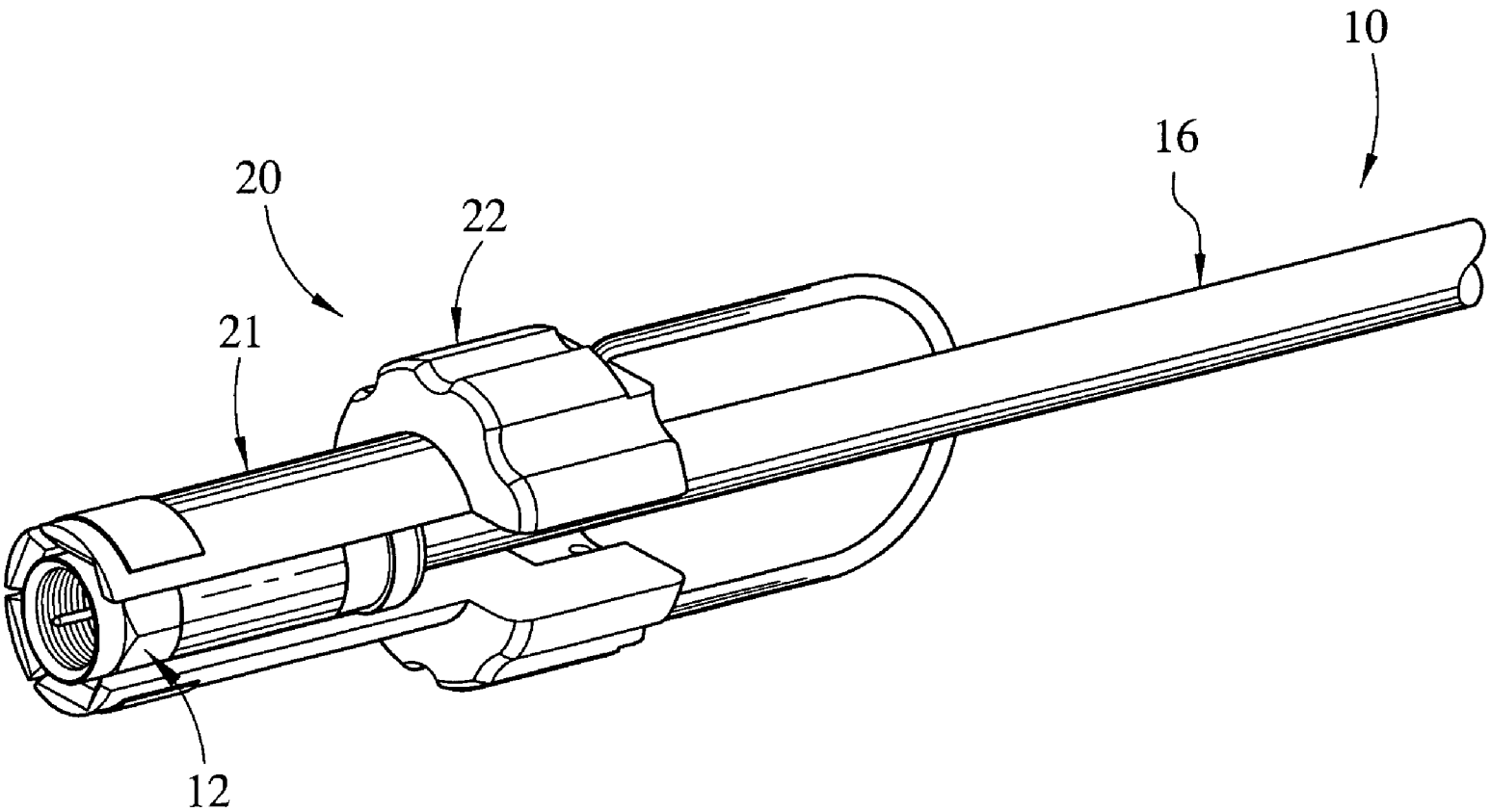
FIG. 5 is a perspective view of the F-type cable structure disposed in the tool to perform the connection step.

In FIG. 5, the F-type cable structure 10 disposed in the tool 20 is prepared to perform the connection step to a designated connector. In the relationship between the F-type cable structure 10 and the tool 20, the rotation of the tool 20 is not interfered by the coaxial cable 16 connected to the male F-type coaxial cable connector 11.

A conventional open spanner can be used to initially loosen or finally tighten the connector ring 12 of the F-type cable structure 10 from the corresponding female F-type connector, however, the nearby cables interferes with the turning of the connector ring 12 by the open spanner.

To overcome the described problem caused by the open spanner, the invention provides the tool to continuously turn the connector ring of the F-type cable structure during the connection or disconnection step even though the nearby cables exist, and the mechanical advantage generated from the tool is sufficient to tighten or loosen the connector ring of the F-type cable structure when the cable thereto is bent and the nearby bent cables exist.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A tool having a torque limiting function comprising:

a) a hollow grasping portion having a second slot communicating with a hollow interior of the hollow grasping portion;

b) a tubular wrench portion connected to the hollow grasping portion and having:

i) four arc portions equally spaced apart and located on a first end thereof, the four arc portions being movable between first and second positions and providing the torque limiting function, the four arc portions having a C-shaped recess located on an exterior periphery thereof;

ii) a hollow body portion located between the four arc portions and the hollow grasping portion; and iii) a first slot extending along a length thereof from the first end to a second end of the tubular wrench portion and communicating with a hollow interior of the tubular wrench portion, the first slot communicating with the second slot, opposing ends of the C-shaped recess are spaced apart from the first slot; and c) a C-shaped fastening ring made of a rigid material and inserted into the C-shaped recess, wherein, when the four arc portions are located in the first position, the four arc portions are held in a normal position by the C-shaped fastening ring, and, when the four arc portions are located in the second position, the four arc portions are pressing outwardly against and deforming the C-shaped fastening ring.

2. The tool according to claim 1, wherein a movement of the four equally spaced arc portions between the first and the second positions is controlled by a tensile strength of the C-shaped fastening ring.

3. The tool according to claim 1, further comprising a stepped thrusting portion located in the hollow interior of the tubular wrench portion and spaced a predetermined distance from the first end of the tubular wrench portion.

4. The tool according to claim 1, wherein opposing ends of the C-shaped fastening ring are spaced apart from the first slot.

* * * * *